US005537783A

United States Patent [19]

Kazino et al.

[11] Patent Number: 5,537,783

[45] Date of Patent: Jul. 23, 1996

[54] HOLDER FOR A WINDOW GLASS OF A VEHICLE

[75] Inventors: Hiroshi Kazino; Masaaki Ide; Hideki Kakamu; Atsushi Kato; Hiromichi Mizuno, all of Aichi-ken, Japan

[73] Assignee: Aoyama Seisakusho Co., Ltd., Aichi-ken, Japan

[21] Appl. No.: 334,914

[22] Filed: Nov. 7, 1994

[30] Foreign Application Priority Data

Nov. 9, 1993 [JP] Japan ..... 5-060089 U
Nov. 17, 1993 [JP] Japan ..... 5-061913 U

[51] Int. Cl.[6] ..... E05F 11/38

[52] U.S. Cl. ..... 49/375; 411/366

[58] Field of Search ..... 49/375, 374; 411/338, 411/366, 369, 371, 542

[56] References Cited

U.S. PATENT DOCUMENTS 3,622,167 11/1971 Velthoven ..... 411/371 X
3,703,053 11/1972 De Rees et al. ..... 49/375 X
4,310,273 1/1982 Kirrish ..... 411/338
4,647,883 3/1987 Oxley ..... 411/366 X
5,205,692 4/1993 Kelbert et al. ..... 411/338 X
5,341,599 8/1994 Cox ..... 49/375
5,363,595 11/1994 Wirsing ..... 49/375

*Primary Examiner*—Jerry Redman
*Attorney, Agent, or Firm*—Frishauf, Holtz, Goodman, Langer & Chick

[57] ABSTRACT

A holder for a window glass of a vehicle which has a reduced number of parts, which can make the mounting operation simpler, thereby lowering costs, and which can prevent the window glass from having play or loosening. The holder comprises a nut and a bolt. The nut has a female screw sleeve portion which is to be inserted with a clearance into a mounting hole formed in the window glass, and a holding plate member radially outwardly extending from the sleeve portion. The bolt has a screw shaft member to be screwed into the female screw sleeve portion, and a holding plate member radially outwardly extending from the screw shaft member. In addition, a cushion layer made of a synthetic thermoplastic resin elastomer is attached to the inside surface of each holding plate member. The cushion layer is provided at its inner circumferential edge with a short sleeve portion for protecting an edge of the mounting hole of the window glass.

6 Claims, 5 Drawing Sheets

HOLDER FOR A WINDOW GLASS OF A VEHICLE

BACKGROUND OF THE INVENTION

The present invention relates to a holder for a window glass of a vehicle which is used for connection with an apparatus for elevating and lowering the window glass.

In an apparatus for elevating and lowering a window glass of a vehicle, it is a general practice to attach plates to both surfaces of a window glass having a mounting hole via shims made of rubber and washers and to tightly fasten the window glass together with an elevating and lowering arm of said apparatus using a bolt and a nut which are integrated with the plates. However, such bolt and nut integrated with the plates increase the costs because of their construction. Accordingly, attempts have been made to make the bolt and nut separately from the plates and then assemble them with each other, or to integrate the bolt and nut with the plates. The former-method involves in that the number of parts increases and that the mounting operation becomes troublesome. This method also has a problem in that a window glass is broken when fastened due to improper contact between the surfaces of the plates and the glass, or loosening occurs afterward. Meanwhile, since the latter method cannot provide sufficient strength for preventing slippage of the bolt or the nut, secure fastening cannot be obtained. Accordingly, the latter method cannot be practically employed.

SUMMARY OF THE INVENTION

An object of the present invention is to solve the above described problems, and to provide an improved holder for a window glass of a vehicle which can reduce the number of parts, thereby making the mounting operation simpler, and which can prevent over-fastening and lateral shift, while providing sufficient strength for secure fastening.

To achieve the above-described object, a holder for a window glass of a vehicle according to the present invention comprises a nut having a female screw sleeve portion which is to be inserted with a clearance into a mounting hole formed in a window glass, and a holding plate member radially outwardly extending from the sleeve portion; and a bolt having a screw shaft member to be screwed into the female screw sleeve portion, and a holding plate member radially outwardly extending from the screw shaft member, wherein a cushion layer made of a synthetic thermoplastic resin elastomer is attached to the inside surface of each holding plate member, the cushion layer being provided at its inner circumferential edge with a short sleeve portion for protecting an edge of the mounting hole of the window glass.

Here, the screw shaft member has a knurled shaft portion and a flange portion which are press-fitted into a central hole of the holding plate member of the bolt for integration. The knurled shaft portion and the flange portion are formed such that they share a common center with the screw shaft member and that one side surface of the flange portion is continued to the knurled shaft portion. The screw shaft member may be a hollow cylindrical member which is formed at the center of the holding plate member of the bolt and perpendicularly extending from said holding plate member of said bolt toward the inner side thereof. In this case, a female screw is threaded on the inner circumferential surface of the hollow cylindrical member for screw engagement with a set screw of an elevating and lowering arm. Alternatively, the screw shaft member may be a solid cylindrical member which is formed at the center of the holding plate member of the bolt and perpendicularly extending from said holding plate member of said bolt toward the both sides thereof.

Also, it is preferred that the cushion layer have a shallow dish-like cross section having an inner diameter corresponding to the outer diameter of the holding plate members, and that engagement claws are provided at the peripheral edge of an opening of the cushion layer, and a hollow short sleeve portion for protecting the edge of the mounting hole be perpendicularly formed at the central portion of the cushion layer.

In the above-described holder for a window glass of a vehicle, the female screw sleeve portion of the nut is inserted with a clearance into the mounting hole formed in the window glass from the outer side of the window glass. And the short sleeve portion for protecting the edge of the mounting hole, which is continuously formed from the inner circumferential edge of the cushion layer, is closely fitted into the mounting hole of the window glass such that the cushion layer abuts the outside surface of the window glass. As described above, the cushion layer is made of a synthetic thermoplastic resin elastomer and attached to the inside surface of the holding plate member extending from the outer end of the female screw sleeve portion. Thereafter, the screw shaft member of the bolt is inserted with a clearance into the mounting hole from the inner side of the window glass while rotating to establish a screw engagement with the female screw sleeve portion of the nut. The bolt is further rotated so that the cushion layer, which is made of a synthetic thermoplastic resin elastomer and attached to the inside surface of the holding plate member of the bolt, abuts the inside surface of the window glass, and that the short sleeve portion for protecting the edge of the mounting hole, which is continuously formed from the inner circumferential edge of the cushion layer, is closely fitted into the mounting hole of the window glass. Subsequently, the elevating and lowering arm is attached to the holding plate member of the bolt, and the elevating and lowering arm is then fixed to the screw shaft member of the bolt.

DESCRIPTION OF PREFERRED EMBODIMENTS

Figure 1:
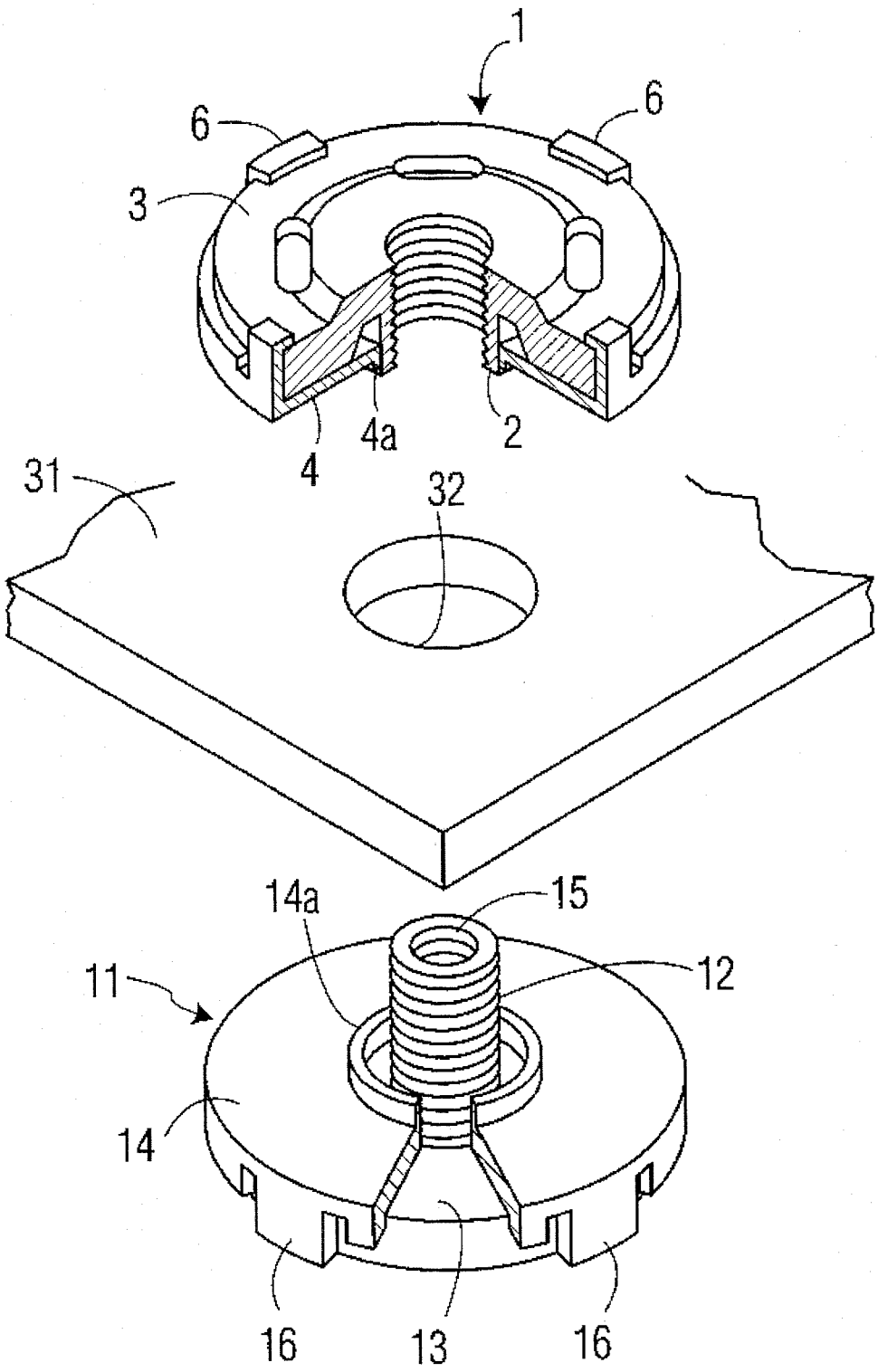
FIG. 1 is a partially cut away perspective view showing a first embodiment of the present invention.
Figure 2:
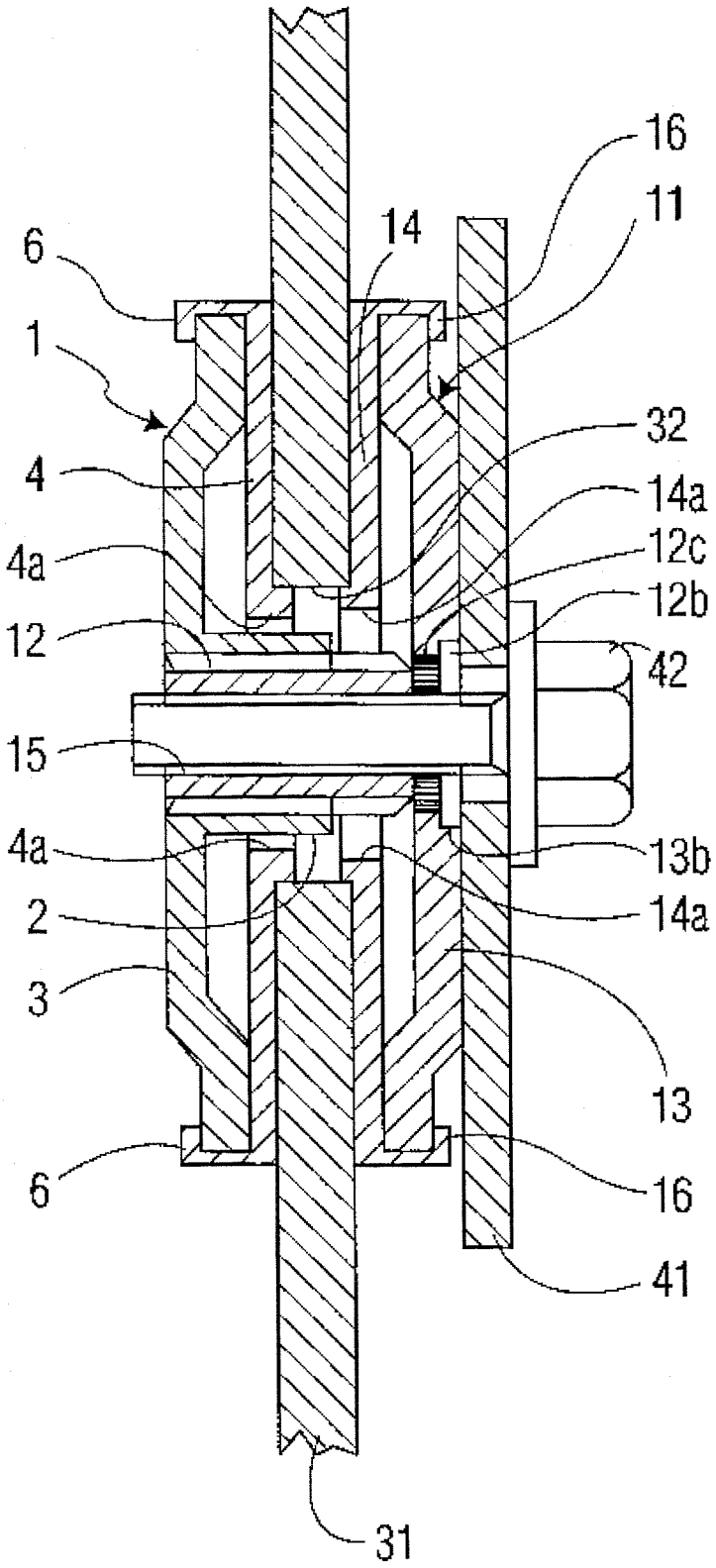
FIG. 2 is a vertical cross section showing the first embodiment of the present invention.
Figure 3:
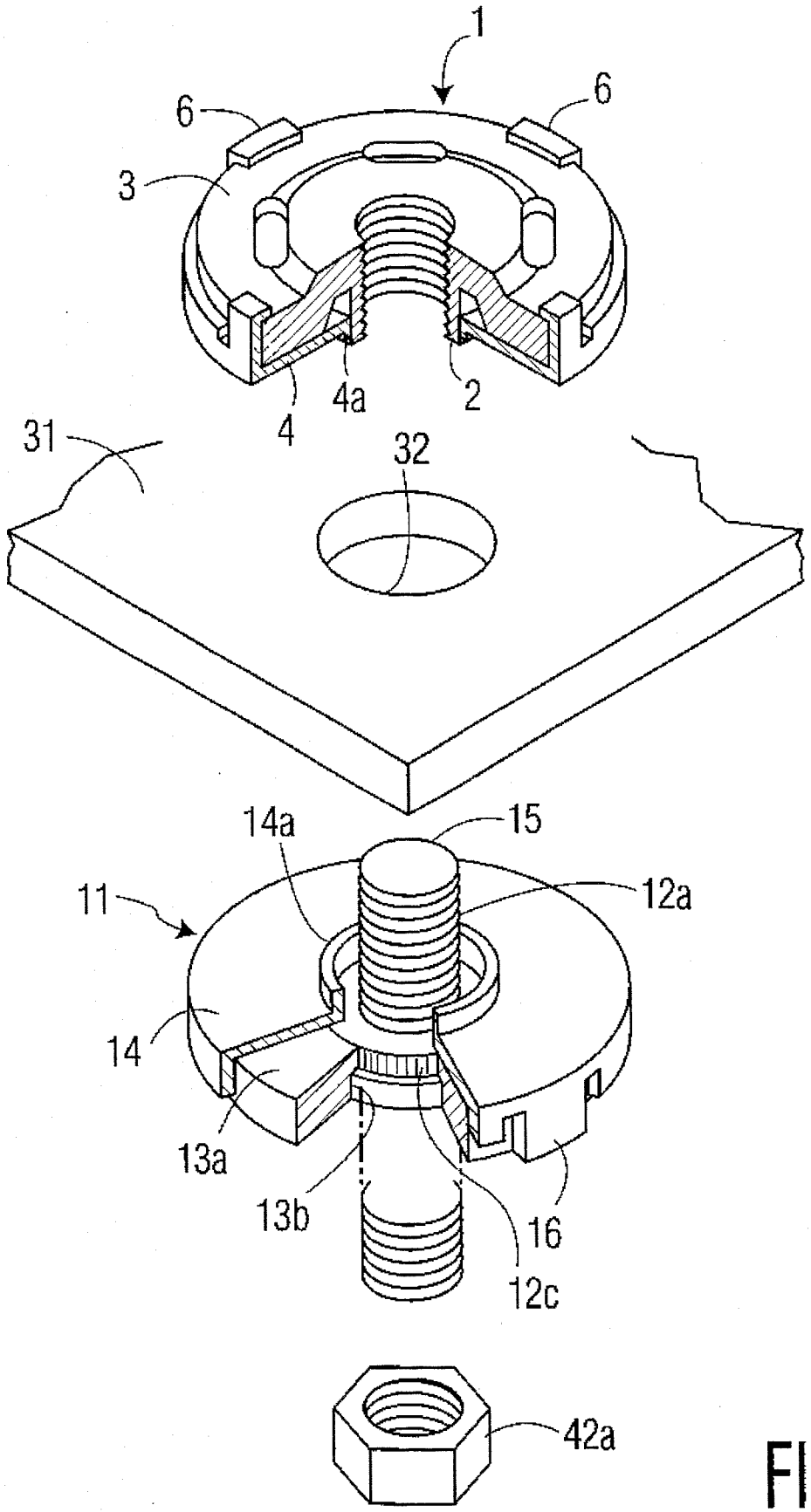
FIG. 3 is a partially cut away perspective view showing a second embodiment of the present invention.
Figure 4:
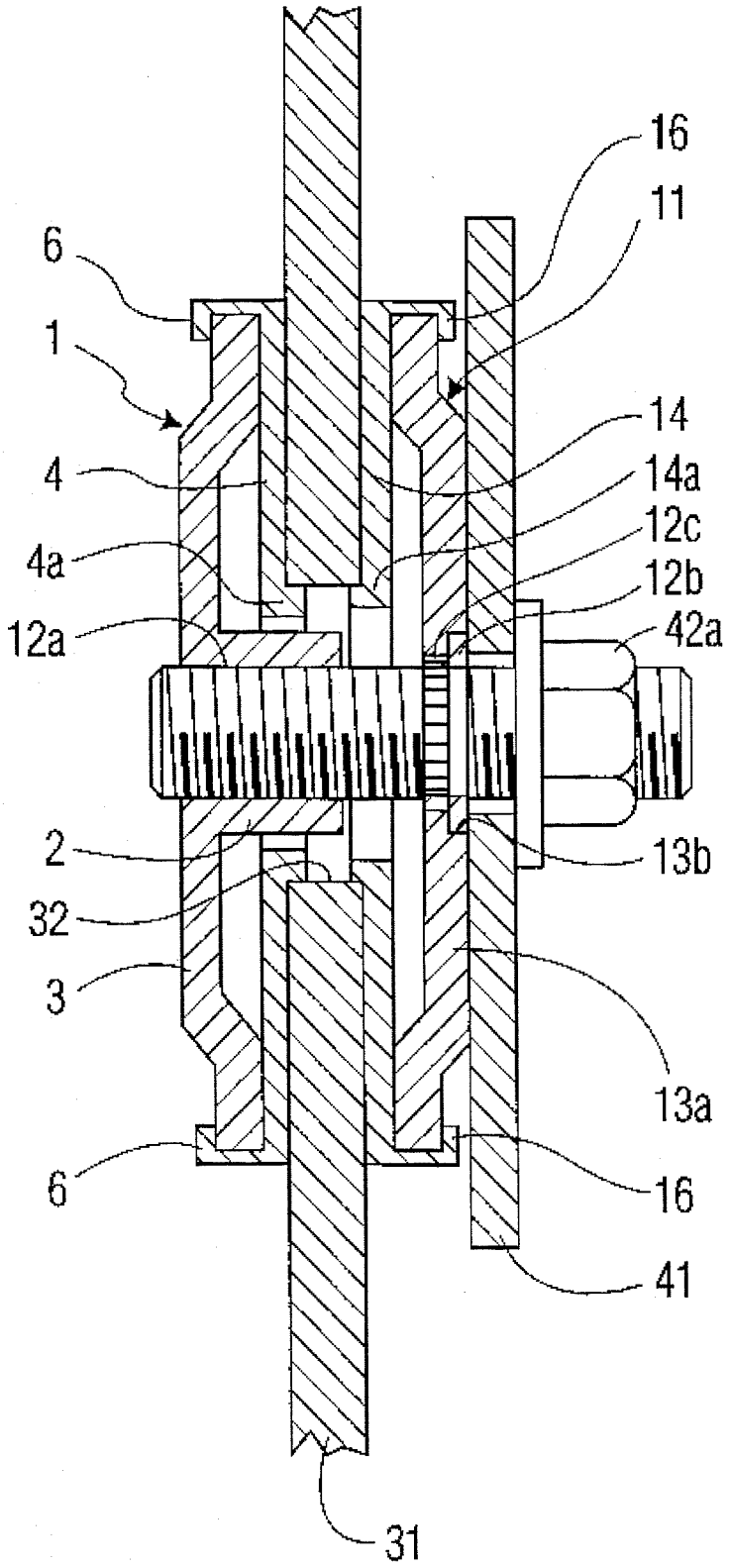
FIG. 4 is a vertical cross section showing the second embodiment of the present invention.

The present invention will now be in detail described with reference to embodiments shown in the accompanying drawings. In the drawings, members denoted by same reference numerals have same functions.

Numeral 1 denotes a nut, and numeral 11 denotes a bolt which is used in combination with the nut 1. Firstly, a metallic nut body is manufactured by cold forging or the like. The metallic nut body has a female screw sleeve portion 2 having an outer diameter which allows the female screw sleeve portion 2 to be inserted with a clearance into a mounting hole 32 formed in a window glass 31, and a holding plate member 3 which is continuously formed from the outer end of the female screw sleeve portion 2. If necessary, a cushion layer 4 which is made of a synthetic thermoplastic resin elastomer and has a thickness of about 0.5 to 1.5 mm is attached to an inside surface of the holding plate member 3 of the nut body. The cushion layer 4 is provided at its inner circumferential edge with a short sleeve portion 4a which is to be fitted into the mounting hole 32 of the window glass 31 for protecting an edge of the mounting hole 32. Although the cushion layer 4 may be a shim made of rubber or a washer which is manually assembled, in order to properly attach the cushion layer 4 to the inside surface of the holding plate member 3, it is preferred that the cushion layer 4 is integrally formed with the holding plate member 3 of the nut body by an insert molding method or the like, or a mold product formed in a separate step is assembled with the holding plate member 3 for integration. From the viewpoint of costs, the structure in the embodiments shown in FIGS. 1–4 is preferred. In detail, a mold product made of a synthetic thermoplastic resin elastomer is made preparation in advance such that the mold product has a shallow dish-like cross section defining a recess or opening having an inner diameter corresponding to the outer diameter of the holding plate member 3, and that engagement claws 6 are provided at the peripheral edge of an opening of the mold product, and the short sleeve portion 4*a* for protecting the edge of the mounting hole is projected from the central portion of the mold product. The nut body is then fitted into the mold product so that the engagement claws 6 are engaged with the outer edge of the holding plate member 3 for integration.

Meanwhile, the following two structures can be used for the bolt 11 which is used in combination with the above-described nut 1.

Structure (1):

In this structure, the bolt 11 has a screw shaft member 12 which has a screw diameter which allows the screw shaft member 12 to be screw engaged with the female screw sleeve portion 2 of the nut 1 and in which a female screw hole 15 is formed at the center thereof to allow an elevating and lowering arm 41 to be fixed to the bolt 11. The bolt 11 also has a holding plate member 13 which is integrally disposed at the outer end of the screw shaft member 12. Both the screw shaft member 12 and the holding plate member 13 are made of metallic material and manufactured by cold forging or the like (See FIG. 1 and FIG. 2). The screw shaft member 12 is provided at its outer end with a knurled shaft portion 12*c* and a flange portion 12*b*. The screw shaft member 12 is press-fitted into the holding plate member 13 for integration such that the inside surface of the knurled shaft portion 12*c* becomes flush with the inside surface of the holding plate member 13, and the outside surface of the flange portion 12*b* becomes flush with the outside surface of the holding plate member 13. For example, the press fitting for integration is carried out as follows. The diameter of the knurled shaft portion 12*c* is made slightly larger than that of the central hole 13*b* of the holding plate member 13, and the diameter of the flange portion 12*b* is made slightly larger than that of the knurled shaft portion 12*c*. After inserting the screw shaft member 12 into the central hole 13*b*, pressure is applied to the screw shaft member 12 until the inner end surface of the flange portion 12*b* abuts on the outside surface of the holding plate member 13 to complete the press fitting of the knurled shaft portion 12*c* into the central hole. As pressure is further applied, a portion of the holding plate member 13 in the vicinity of the opening of the central hole is pushed by the flange portion 12*b* and enters the bottoms of grooves of the knurled shaft portion 12*c*. By stopping the application of the pressure when the outside surface of the knurled shaft portion 12*c* and the outside surface of the flange portion 12*b* ultimately become flush with the inside and outside surfaces, respectively, of the holding plate member 13, the press fitting for integration is completed.

Structure (2):

In this structure, a screw shaft member 12*a* having a screw diameter which allows the screw shaft member 12*a* to be screw engaged with the female screw sleeve portion 2 of the nut 1 is press-fitted into a central hole 13*b* of a holding plate member 13*a* for integration. In detail, the screw shaft member 12*a* is provided at axially central portion thereof with a knurled shaft portion 12*c* and a flange portion 12*b* which both radially extend for preventing rotation and coming out of the screw shaft member 12*a*. The screw shaft member 12*a* is press-fitted into the central hole 13*b* of the holding plate member 13*a* for integration so that the outside surface of the flange portion 12*b* becomes flush with the outside surface of the holding plate member 13*a* (the integrated members are called "bolt body"). The screw shaft member 12*a* and the holding plate member 13*a* are both made of a metallic material and manufactured by cold forging or the like (See FIG. 3 and FIG. 4). The press-fitting of the knurled shaft portion 12*c* and the flange portion 12*b* into the holding plate member 13*a* can be carried out in a manner similar to that in the structure (1). In this embodiment, however, it is to be noted that the knurled shaft portion 12*c* and the flange portion 12*b* are disposed not at the outer end portion of the screw shaft member 12*a* but disposed at the central region thereof.

Like the above-described nut, a cushion layer 14 which is made of a synthetic thermoplastic resin elastomer and has a thickness of about 0.5 to 1.5 mm is attached to the inside surface of the holding plate member 13 or 13*a* of the bolt, if necessary. The cushion layer 14 may also be a shim made of rubber or a washer which is manually assembled. However, in order to properly attach the cushion layer 14 to the inside surface of the holding plate member 13 or 13*a*, it is preferred that the cushion layer 14 is integrally formed with the holding plate member 13 or 13*a* by an insert molding method or the like, or a mold product formed in a separate step is assembled with the holding plate member 13 or 13*a* for integration. When considering costs, the structure in the embodiments are preferred. In detail, a mold product made of a synthetic thermoplastic resin elastomer is made preparation in advance such that the mold product has a shallow dish-like cross section having an inner diameter corresponding to the outer diameter of the holding plate member 13 or 13*a*, and that engagement claws 16 are provided at the peripheral edge of an opening of the mold product, and a short sleeve portion 14*a* for protecting the edge of the mounting hole is projected from the central portion of the mold product. The bolt body is then fitted into the mold product so that the engagement claws 16 are engaged with the outer edge of the holding plate member 13 or 13*a* for integration.

The synthetic resin elastomer used as a raw material of the cushion layers 4 and 14 is preferred to have durability and strength not being inferior to a polyamide resin which has been used for a conventional washer used in assembling a window glass with an apparatus for elevating and lowering a window grass of a vehicle, and to have a property as a cushion being superior to the polyamide resin. For example, HYTREL (trademark, product of Toray Industries, Inc.), which is a thermoplastic elastomer of a polyetherester, PELPRENE (trademark, product of Toyobo Co., Ltd.), which is a thermoplastic elastomer of a polyester, or the like can be used. When the thickness of the cushion layers 4, 14 is equal to or greater than 0.5 mm, a sufficient buffer function, and a function of providing close contact can be securely obtained even when a shim made of rubber is omitted. In addition, when the glass is slidden, the cushion layers 4 and 14 absorb the influence of the curvature of the glass so that the glass is supported by the holding plate members 3 and 13, 13*a* with a constant surface pressure, thereby stabilizing the stress applied to the window glass. Accordingly, the glass can be smoothly elevated and lowered without play.

Figure 5:
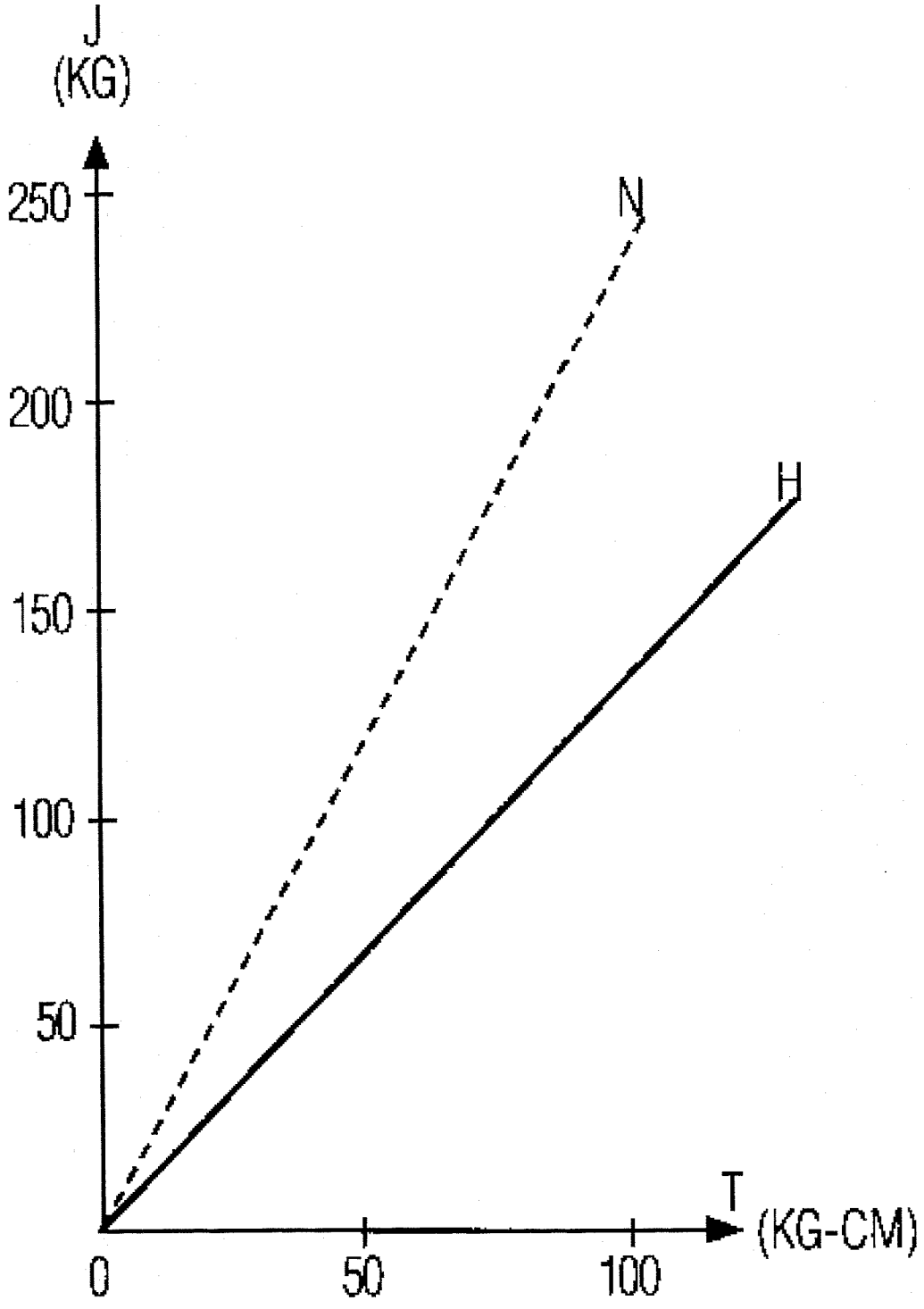
FIG. 5 is a graph showing the results of an experiment for obtaining the relationship between torque and axial tension for different materials used for a cushion layer.

The reason why the cushion layers 4 and 14 made of the above-described synthetic resin elastomer is preferred will now be described with reference to FIG. 5 showing the results of an experiment in which the relationship between fastening torque (kg) and axial tension (kg) was obtained for different materials. In FIG. 5, H shows the case in which a cushion layer was made of HYTREL which is an example of a synthetic resin elastomer, N shows the case in which a cushion layer was made of 6-Nylon which is a typical polyamide resin. When compared at a torque of 100 kg-cm, the axial tension of HYTREL H is 135 kg, while the axial tension of 6-Nylon is 235 kg. Accordingly, it is understood that the use of HYTREL H reduces the stress by 43% compared to 6-Nylon N for the same fastening torque of 100 kg. Since small fastening torque results in loosening of a window glass, it is preferred to reduce the axial tension while maintaining a high fastening torque. When the cushion layer made of HYTREL H is used, it is possible to prevent loosening, and also prevent the mounting hole of the glass from being fastened with excessive force. Accordingly, no breakages are generated in the window glass. In addition, a test was performed wherein a glass holder was attached to a window glass with the above-described fastening torque, and a lateral shift was measured by pulling the holder in a direction along a surface of the window glass using a tensile tester. The results of the test showed that the tensile forces measured in a sole use of 6-Nylon, a combined use of 6-Nylon and a shim made of rubber, and a sole use of HYTREL were 72.0 kg, 57.0 kg and 73.3 kg, respectively. This demonstrates that the sole use of HYTREL was the best.

In the holder having the above-described structure, the female screw sleeve portion 2 of the nut 1 is inserted with a clearance into the mounting hole 32 formed in the window glass 31 from the outer side of the window glass 31. And the short sleeve portion 4*a* for protecting the edge of the mounting hole 32, which is continuously formed from the inner circumferential edge of the cushion layer 4, is closely fitted into the mounting hole 32 such that the cushion layer 4 abuts the outside surface of the window glass 31. As described above, the cushion layer 4 is made of a synthetic thermoplastic resin elastomer and attached to the inside surface of the holding plate member 3 extending from the outer end of the female screw sleeve portion 2. Thereafter, one end of the screw shaft portion 12 of the bolt 11 is inserted with a clearance into the mounting hole 32 from the inner side of the window glass 31. A turning tool is then engaged with a tool engagement portion formed in the other end of the screw shaft portion 12 to rotate the bolt 11. With this operation, the screw shaft member 12 is screw engaged with the female screw sleeve portion 2 of the nut 1 (in the case shown in FIG. 3 and FIG. 4, a half of the screw shaft member 12*a* is screw engaged with the female screw sleeve portion 2). The bolt 11 is further rotated so that the short sleeve portion 14*a* for protecting the edge of the mounting hole 32, which is formed on the cushion layer 14 to perpendicularly extend therefrom, is closely fitted into the mounting hole 32, and that the cushion layer 14 abuts the inside surface of the window glass 31. As described above, the cushion layer 14 is made of a synthetic thermoplastic resin elastomer and attached to the inside surface of the holding plate member 13 or 13*a* extending from the screw shaft portion 12. Subsequently, the elevating and lowering arm 41 is placed on the outside surface of the holding plate member 13, and the elevating and lowering arm 41 is then fixed by screwing a set screw 42 into the female screw 15 formed at the center of the screw shaft member 12 (see FIG. 2). In the holder shown in FIG. 3 and FIG. 4, the assemble of the elevating and lowering arm 41 is carried out as follows. The elevating and lowering arm 41 is engaged with a projected end of the screw shaft portion 12*a* which is projected from the outside surface of the holding plate member 13*a*. The elevating and lowering arm 41 is then fixed using a nut 42*a*. Since the bolt 11 is integrally formed by press fitting the screw shaft member 12 or 12*a* having the knurled shaft portion 12*c* and the flange portion 12*b* into the central hole 13*b* of the holding plate member 13 or 13*a* such that an engagement is made through the knurled shaft portion 12*c* and the flange portion 12*b*, the bolt 11 can provide sufficient strength for preventing rotation and coming out of the screw shaft member 12 or 12*a*. This strength is substantially the same as that in the case the screw shaft portion 12 or 12*a* and the holding plate member 13 or 13*a* are integrally formed. Accordingly, a secure fastening can be obtained. In addition, the number of parts is small and the mounting operation is simple. Moreover, since improper contact does not occur between the surfaces of the holding plates and the surfaces of the window glass and the stress produced by fastening is reduced, the problem of breakage of the window glass or loosening of the window glass does not occur. Furthermore, even when the surfaces of the window glass are curved, the influence of the curvature can be absorbed effectively.

Since the cushion layers 4 and 14 are integrally formed on the inside surfaces of the holding plate members 3 and 13, 13*a*, the workability can be improved, and close contact between the surfaces of the holding plates and the surfaces of the window glass can be easily obtained. Particularly, in the holders shown in the drawings, the mold product made of a synthetic thermoplastid resin elastomer is made preparation in advance such that it has a shallow dish-like cross section, a short sleeve portion 4*a*, 14*a*, serving for protecting the edge of the mounting hole, at the central portion thereof and engagement claws 6, 16 at the peripheral edge of the opening thereof, and the nut body or the bolt body is then fitted into the mold product so that the engagement claws 6, 16 are engaged with the outer edge of the holding plate member 3 or 13, 13*a* for integration. Such holders can cheaply be manufactured, thereby lowering the production costs. In addition, the work for manually attaching a plurality of parts such as a shim made of rubber and a washer to both surfaces of a window glass can be removed from the assembly line. In addition, the short sleeve portions 4*a*, 14*a* for protecting the edges of the mounting hole, which are provided on the nut 1 and the bolt 11, can easily and securely be inserted into the mounting hole 32 of the window glass 31 in a short period of time. This also prevents improper assembly. With the cushion effect of the cushion layers 4, 14 which are made of a synthetic thermoplastic resin elastomer and which are provided at their inner circumferential edges with the short sleeve portions 4*a*, 14*a* for protecting the edges of the mounting hole, the window glass is prevented from being broken when fastened, and the plates are prevented from loosening afterward. Therefore, the above-described structure is particularly preferred.

As is apparent from the above-described description, in the present invention, the holding plate members are integrated with the screw shaft member and the female screw sleeve portion. Accordingly, the number of parts can be reduced and the mounting operation can also be made simpler, thereby lowering the production costs. In addition, since the edges of the mounting hole of the window glass are properly protected, the window glass is prevented from being broken when fastened, and the holding plates are prevented from loosening afterward. Moreover, the influence of the curvature of the window glass can be absorbed by the cushion layers. The holder according to the present invention further has advantages that a strength being sufficient for preventing the screw shaft member from coming out can be obtained, thereby realizing secure fastening, because the knurled shaft portion and the flange portion is press-fitted into the holding plate member for integration. In addition, the embodiment shown in FIG. 3 and FIG. 4 has an advantage that the elevating and lowering arm can easily be attached to the screw shaft member.

Accordingly, the present invention, which has solved the problems of conventional holders for a window glass of a vehicle, has great practical merits.

What is claimed is:

1. A holder for a window glass of a vehicle, comprising:

a nut (1) having a female screw sleeve portion (2) which is insertable with a clearance into a mounting hole (32) formed in the window glass (31), and a first holding plate member (3) radially outwardly extending from the female screw sleeve portion (2);

a bolt (11) having a screw shaft member (12, 12*a*) which is screwable into the female screw sleeve portion (2), and a second holding plate member (13, 13*a*) radially outwardly extending from the screw shaft member (12, 12*a*);

a respective cushion layer (4, 14) made of a synthetic thermoplastic resin elastomer attached to an inside surface of each of the first and second holding plate members, each of the respective cushion layers having on an inner circumferential edge thereof, a short sleeve portion (4*a*, 14*a*) extending substantially perpendicular to the first and second holding plate members so as to be at least partially received in the mounting hole (32) of the window glass for protecting an edge of the mounting hole (32) of the window glass; and wherein the screw shaft member (12, 12*a*) has a knurled shaft portion (12*c*) and a flange portion (12 *b*) which are press-fitted into a central hole (13 *b*) of the second holding plate member (13, 13*a*), and wherein the knurled shaft portion (12 *c*) and flange portion (12 *b*) are formed such that they share a common center with the screw member (12, 12*a*) and such that the flange portion (12 *b*) has a side surface which is continuous with the knurled shaft portion (12 *c*).

2. The holder according to claim 1, wherein the screw shaft member (12) comprises a hollow cylindrical member at a central portion of the second holding plate member (13) and which perpendicularly extends from the second holding plate member toward an inner side of the second holding plate member, the hollow cylindrical member having a female thread screw (15) on an inner circumferential surface thereof for screw engagement with a set screw (42) of an elevating and lowering arm (41).

3. The holder according to claim 2, wherein:

each respective cushion layer (4, 14) has a shallow dish-like cross section having an outer peripheral edge which defines a recess, the recess having an inner diameter corresponding to an outer diameter of the first and second holding plate members (3, 13, 13*a*), engagement claws (6, 16) are provided at the outer peripheral edge of each respective cushion layer, and the short sleeve portion (4*a*, 14*a*) for protecting the edge of the mounting hole (32) is perpendicularly formed at a central portion of each respective cushion layer.

4. The holder according to claim 1, wherein the screw shaft member (12*a*) comprises a solid cylindrical member at a central portion of the second holding plate member (13*a*) and which perpendicularly extends from the second holding plate member on both opposite sides of the second holding plate member (13*a*).

5. The holder according to claim 4, wherein:

each respective cushion layer (4, 14) has a shallow dish-like cross section having an outer peripheral edge which defines a recess, the recess having an inner diameter corresponding to an outer diameter of the first and second holding plate members (3, 13, 13*a*), engagement claws (6, 16) are provided at the outer peripheral edge of each respective cushion layer, and the short sleeve portion (4*a*, 14*a*) for protecting the edge of the mounting hole (32) is perpendicularly formed at a central portion of each respective cushion layer.

6. The holder according to claim 1, wherein:

each respective cushion layer (4,14) has a shallow dish-like cross section having an outer peripheral edge which defines a recess, the recess having an inner diameter corresponding to an outer diameter of the first and second holding plate members (3, 13, 13*a*), engagement claws (6, 16) are provided at the outer peripheral edge of each respective cushion layer, and the short sleeve portion (4*a*, 14*a*) for protecting the edge of the mounting hole (32) is perpendicularly formed at a central portion of each respective cushion layer.

* * * * *